US010082021B2

(12) United States Patent
Zheng et al.

(10) Patent No.: US 10,082,021 B2
(45) Date of Patent: Sep. 25, 2018

(54) AZIMUTHALLY ACOUSTIC WHILE DRILLING SIGNAL RECEIVING TRANSDUCER ENCAPSULATING APPARATUS

(71) Applicant: Institute of Geology and Geophysics, Chinese Academy of Sciences, Beijing (CN)

(72) Inventors: Jian Zheng, Beijing (CN); Wenxuan Chen, Beijing (CN); Qingyun Di, Beijing (CN); Yuntao Sun, Beijing (CN); Yongyou Yang, Beijing (CN); Wenxiu Zhang, Beijing (CN)

(73) Assignee: INSTITUTE OF GEOLOGY AND GEOPHYSICS, CHINESE ACADEMY OF SCIENCES, Beijing (CN)

( * ) Notice: Subject to any disclaimer, the term of this patent is extended or adjusted under 35 U.S.C. 154(b) by 0 days.

(21) Appl. No.: 15/818,268

(22) Filed: Nov. 20, 2017

(65) Prior Publication Data

US 2018/0142551 A1 May 24, 2018

(30) Foreign Application Priority Data

Nov. 21, 2016 (CN) ..... 2016 1 1022891

(51) Int. Cl.
*E21B 47/14* (2006.01)
*E21B 47/01* (2012.01)

(52) U.S. Cl.
CPC ..... *E21B 47/14* (2013.01); *E21B 47/011* (2013.01)

(58) Field of Classification Search
CPC ..... E21B 47/14; E21B 47/011
USPC ..... 367/81
See application file for complete search history.

(56) References Cited

U.S. PATENT DOCUMENTS 6,177,882 B1 * 1/2001 Ringgenberg ..... E21B 47/122 324/342
7,096,313 B1 8/2006 Chang et al.
7,364,007 B2 * 4/2008 Garcia-Osuna ..... E21B 47/01 181/108
7,762,854 B1 7/2010 Peng
(Continued)

FOREIGN PATENT DOCUMENTS

CN 1740746 A 3/2006
CN 2849164 Y 12/2006
(Continued)

*Primary Examiner* — Zhen Y Wu
(74) *Attorney, Agent, or Firm* — Novick, Kim & Lee, PLLC; Allen Xue

(57) ABSTRACT

An azimuthally acoustic while drilling signal receiving transducer encapsulating apparatus includes a drill collar, a receiving transducer, a preposed signal processing circuit and a master control electronics housing. The receiving transducer and the preposed signal processing circuit are encapsulated on a drill collar body individually. The receiving transducer and the signal processing circuit are electrically connected by a sealing electrical connector. The preposed signal processing circuit and the master control electronic housing are electrically connected. The signal processing circuit is preposed in terms of signal processing, and encapsulated on the drill collar, so that signal receiving and processing cable length is shortened and noise interference is reduced.

10 Claims, 3 Drawing Sheets

(56) References Cited

U.S. PATENT DOCUMENTS

| | | | | |
|---|---|---|---|---|
| 9,097,100 | B2 * | 8/2015 | Finke | E21B 47/011 |
| 9,376,908 | B2 * | 6/2016 | Ludwig | E21B 47/011 |
| 9,476,293 | B2 * | 10/2016 | Nakajima | G01V 1/186 |
| 9,631,485 | B2 * | 4/2017 | Keller | E21B 47/011 |
| 9,658,362 | B2 * | 5/2017 | Hernandez Marti | E21B 47/011 |
| 9,677,362 | B2 * | 6/2017 | Surjaatmadja | E21B 29/005 |
| 2001/0012703 | A1 | 8/2001 | Wurm et al. | |
| 2002/0075114 | A1 | 6/2002 | Hall et al. | |
| 2005/0150713 | A1 * | 7/2005 | Garcia-Osuna | E21B 47/01 181/108 |
| 2007/0247329 | A1 | 10/2007 | Petrovic et al. | |
| 2009/0023502 | A1 | 1/2009 | Koger | |
| 2009/0153355 | A1 | 6/2009 | Price et al. | |
| 2012/0186335 | A1 * | 7/2012 | Pace | E21B 47/0002 73/152.47 |
| 2012/0249338 | A1 | 10/2012 | Merino | |
| 2012/0299743 | A1 | 11/2012 | Price et al. | |
| 2012/0324993 | A1 * | 12/2012 | Nakajima | E21B 47/011 73/152.47 |
| 2013/0125641 | A1 * | 5/2013 | Chemali | E21B 47/00 73/152.47 |
| 2014/0332235 | A1 | 11/2014 | Mueller et al. | |
| 2015/0330208 | A1 * | 11/2015 | Haubold | E21B 47/011 166/380 |
| 2016/0333646 | A1 * | 11/2016 | Olin | E21B 47/01 |
| 2018/0051550 | A1 * | 2/2018 | Ren | E21B 47/0006 |

FOREIGN PATENT DOCUMENTS

| | | | |
|---|---|---|---|
| CN | 101289935 | A | 10/2008 |
| CN | 201221354 | Y | 4/2009 |
| CN | 101493008 | A | 7/2009 |
| CN | 102418516 | A | 4/2012 |
| CN | 202187758 | U | 4/2012 |
| CN | 103061755 | A | 4/2013 |
| CN | 103577121 | A | 2/2014 |
| CN | 204283400 | U | 4/2015 |
| CN | 204283413 | U | 4/2015 |
| CN | 105353357 | A | 2/2016 |
| CN | 105760113 | A | 7/2016 |
| CN | 105804722 | A | 7/2016 |
| CN | 206299372 | U | 7/2017 |
| CN | 206299375 | U | 7/2017 |

* cited by examiner

AZIMUTHALLY ACOUSTIC WHILE DRILLING SIGNAL RECEIVING TRANSDUCER ENCAPSULATING APPARATUS

TECHNICAL FIELD

The present invention mainly pertains to the field of logging while drilling (LWD) measurement apparatuses, and particularly relates to an azimuthally acoustic while drilling signal receiving transducer encapsulating apparatus.

BACKGROUND

With the increasing drilling scale of oil and gas fields and the development of science and technology, especially the rapid development of a LWD technology, it is urgent to make the present advanced science and technology play an important role in the development of the oil and gas fields. An azimuthally acoustic LWD technology is one of LWD technologies, and an azimuthally acoustic while drilling transducer is one of the most important elements of an azimuthally acoustic while drilling instrument. During operation, a transmitting transducer built in the instrument generates acoustic waves. The acoustic waves are received by a receiving transducer in the same instrument. Properties of a reference medium are evaluated by means of acoustic information such as velocity and attenuation of various modes of the received waves. Since a fluid conduit through which mud passes is provided in the middle of the while drilling instrument, and an acoustic wave transducer is mounted on the outer wall of a drill collar body, which is immersed in oil and other fluids. As a wireline acoustic logging instrument, the azimuthally acoustic while drilling transducer is generally independently encapsulated. However, there are two types of azimuthally acoustic while drilling receiving transducers, namely, a button-shaped receiving transducer and an annularly-potted receiving transducer. The button-shaped receiving transducer is directly mounted in an electronic housing at a receiving end of the acoustic while drilling instrument. Such a transducer has a high sensitivity. The annularly-potted receiving transducer encapsulates multiple transducers into an annular ribbon structure, and a receiving chip is internally connected in parallel to form a receiving transducer. Such a receiving transducer is mainly used for a monopole azimuthally acoustic while drilling instrument.

The button-shaped receiving transducer encapsulating apparatus is configured as follows. A ceramic structure crystal is encapsulated into a button-shaped metal structure. The balance between mud external to a ceramic crystal plate and hydraulic oil internal to the ceramic sheet crystal is realized by means of a hydraulic balance apparatus in the button-shaped metal structure. The ceramic crystal plate needs to realize dynamic sealing in the button-shaped structure. That is, balancing the mud external to the ceramic crystal plate and the hydraulic oil internal to the ceramic crystal plate. Such a button-shaped receiving transducer is directly mounted on a frame of the electronic housing at the receiving end. Sealing of the mud external to the ceramic crystal plate and the electronic housing is realized by means of a sealing ring outside the button-shaped structure. Meanwhile, a dual-core electrical connection pin at the bottom of the transducer may realize a short-distance connection with a receiving circuit, so that a weak acoustic signal is received.

The annularly-potted receiving transducer encapsulating apparatus is realized as follows. A flake ceramic crystal plate structure is employed. A receiving chip is encapsulated into an annular ribbon. The receiving chip is internally connected in parallel to form a receiving transducer. An annular ribbon structure leads a chip signal receiving line out through a sealing structure and electrically connects two signal receiving lines with the internal electronic housing through a specially-designed sealing electrical connector. The transducer employing an epoxy resin potting sealant may be soaked in the mud, sealing the external mud and the internal electronic housing is realized by means of the specially-designed sealing electrical connector, so that a weak acoustic signal is received.

These two apparatuses respectively have disadvantages as explained in the following.

The button-shaped receiving transducer encapsulating apparatus increases the complexity of designing the transducer due to a requirement for a hydraulic dynamic balance design of the ceramic crystal plate and is susceptible to failure in use. The ceramic crystal plate of such a button-shaped transducer is exposed in the mud by adhering a layer of PEEK material on its outer surface, and is prone to damage in a downhole complex application environment; and because the transducer realizes high-pressure sealing with the drill collar body while being mounted on the frame of the internal electronic housing, such a structure increases requirements for machining and assembling the frame of the internal electronic housing and the external drill collar body; and The annularly-potted receiving transducer encapsulating apparatus requires the specially-designed sealing electrical connector when being electrically connected with the internal housing for the electronics to meet requirements that the plug is in abut-joint with an electrical connector on the electronic circuit while realizing high-pressure sealing; meanwhile, it is required that the connector can be affixed to the drill collar body due to a downhole application environment with strong vibration shock; such an encapsulating structure on the one hand requires the specially-designed sealing connector, on the other hand increases requirements for machining and assembling the frame of the internal housing for the electronics and the external drill collar body; and furthermore, compared with the button-shaped transducer encapsulating structure, this structure increases the length of an electronic connection line from the transducer to the housing for electronics, which affects the signal extraction.

SUMMARY

In view of the above-mentioned technical challenges, the present invention provides an azimuthally acoustic while drilling signal receiving transducer encapsulating apparatus, wherein an amplifier circuit and an analog-to-digital conversion circuit are disposed on a drill collar near the transducer, i.e., preposed signal processing circuit(s), which shortens the length of the cable for signal receiving and processing and reduces noise interference. The receiving transducer encapsulation and electrical connection encapsulation are separately performed to relax the requirement for the shape of an electrical connector. It also accomplishes sealing of the transducer and preposed signal processing circuits from mud by employing a common high-pressure sealing electrical connector, not a specially-designed high-pressure electrical connector.

The present invention is achieved by the following technical solution:

An azimuthally acoustic while drilling signal receiving transducer encapsulating apparatus includes a drill collar body 2, a housing for master control electronics 1 and an azimuthally acoustic while drilling signal receiving and processing system.

The azimuthally acoustic while drilling signal receiving and processing system includes a receiving transducer 3, sealing electrical connectors, a preposed signal processing circuit 10 and a main signal processing circuit. The main signal processing circuit is housed in the master control electronics housing 1. The sealing electrical connectors are encapsulated on the drill collar body 2. The receiving transducer 3 and the preposed signal processing circuit 10 are subjected to high-pressure sealing on the drill collar body 2 by encapsulating structures. The receiving transducer 3 and the signal processing circuits 10 are electrically connected by sealing electrical connectors. The preposed signal processing circuit 10 and the main signal processing circuit are electrically connected. The preposed signal processing circuit 10 include a signal amplifying circuit and an analog-to-digital conversion circuit.

The apparatus employs the novel independently-encapsulated transducer and the high-pressure sealing electrical connectors to achieve the sealing of the transducer and the preposed signal processing circuit from mud, which renders unnecessary a dynamic sealing design of the ceramic crystal plate and the specially-designed high-pressure sealing electrical connectors. Meanwhile, the signal processing circuit are preposed to be close to the transducer and encapsulated on the drill collar. Accordingly, the length of the cable for signal receiving and processing is shortened and noise interference is reduced as a result. Requirements for designing, machining and assembling the electronic connectors of the master control electronic housing and the drill collar are less stringent, and system reliability is improved.

Further, the preposed signal processing circuit 10 are encapsulated on the drill collar body 2 by an encapsulating structure. The encapsulating structure of the preposed signal processing circuit 10 and external portions of the sealing electrical connectors are respectively sleeved with at least one sealing ring to realize high-pressure sealing.

Further, the preposed signal processing circuit 10 are connected with an electrical connector mounted on the master control electronics housing 1 through second signal cables to realize electrical connection of the signal processing circuit 10 and the master control electronic housing 1.

Further, the receiving transducer 3 includes a sensor and an encapsulating structure external to the sensor. The encapsulating structure of the receiving transducer 3 is formed by potting of an epoxy resin potting sealant. The encapsulating structure of the receiving transducer 3 seals the sensor under high pressure. The receiving transducer 3 is affixed on the drill collar body 2 by means of a fixing apparatus and a signal of the receiving transducer 3 is led out of the encapsulating structure through a first signal transmission cable.

Further, the encapsulating structure is a rectangular parallelepiped structure having a single cambered surface, and a surface, which is in contact with the encapsulating structure, of the second fixing apparatus is a cambered surface. A cambered surface means that a slightly arched surface.

Further, the receiving transducer 3 performs signal transmission by using three outgoing cables, including a positive electrode, a negative electrode, and a ground.

Further, the electrical connector includes a multi-core connection pin 11 and a multi-core connection socket 12, and the multi-core connection pin 11 and the multi-core connection socket 12 are engaged.

Further, the encapsulating structure of the preposed signal processing circuit 10 has a sealing cover 9, the preposed signal processing circuit 10 are located in the sealing cover 9, and the sealing cover 9 is affixed to the drill collar body 2.

Further, the sealing electrical connector includes a three-core sealing pin 8 and a three-core sealing rubber sleeve 5, which are mutually engaged and mounted, and the receiving transducer 3 is connected with the three-core sealing rubber sleeve 5.

Further, the encapsulating structure of the preposed signal processing circuit 10 and the sealing electrical connector are affixed to the drill collar body 2 by means of retaining rings, respectively, to ensure that they do not fall off from the drill collar body in a downhole environment with strong vibration.

The present invention has many advantageous effects:

(1) the encapsulating apparatus of the present invention separately employs receiver sealing and electrical connection sealing so as to reduce requirements for machining and assembling parts and a design requirement for the electrical connector, and realizes the sealing of the mud of the transducer and the preposed signal processing circuits by adopting a common high-pressure sealing electrical connector without the specially-designed high-pressure electrical connector, while ensuring downhole operation reliability;

(2) the azimuthally acoustic while drilling signal receiving transducer encapsulating apparatus of the present invention adopts an epoxy resin potting sealant to encapsulate the transducer into a rectangular parallelepiped structure one surface of which is a cambered surface, thereby avoiding a dynamic sealing design of the ceramic crystal plate;

(3) the present invention shortens signal receiving and processing cable length and reduces noise interference by adopting a modular design of preposing the amplifier circuit and the analog-to-digital conversion circuit;

(4) the signal processing circuit is connected with the internal electronic housing by adopting a flexible cable so as to avoid a design requirement for aligning the electrical connector of the electronic housing with the drill collar body; and (5) the present invention may be applied to acoustic wave receiving systems of dipole and multi-pole azimuthally acoustic while drilling instruments.

DETAILED DESCRIPTION

Objectives, technical solutions and advantages of the present invention will become more apparent from the following detailed description of the present invention when taken in conjunction with accompanying drawings. It should be understood that specific embodiments described herein are merely illustrative of the present invention and are not intended to limit the present invention.

Rather, the present invention encompasses any alternatives, modifications, equivalents, and solutions made within the spirit and scope of the present invention as defined by the claims. Further, in order to give the public a better understanding of the present invention, some specific details are described below in detail in the following detailed description of the present invention. It will be appreciated by those skilled in the art that the present invention may be understood without reference to the details.

EXAMPLE 1

Figure 1:
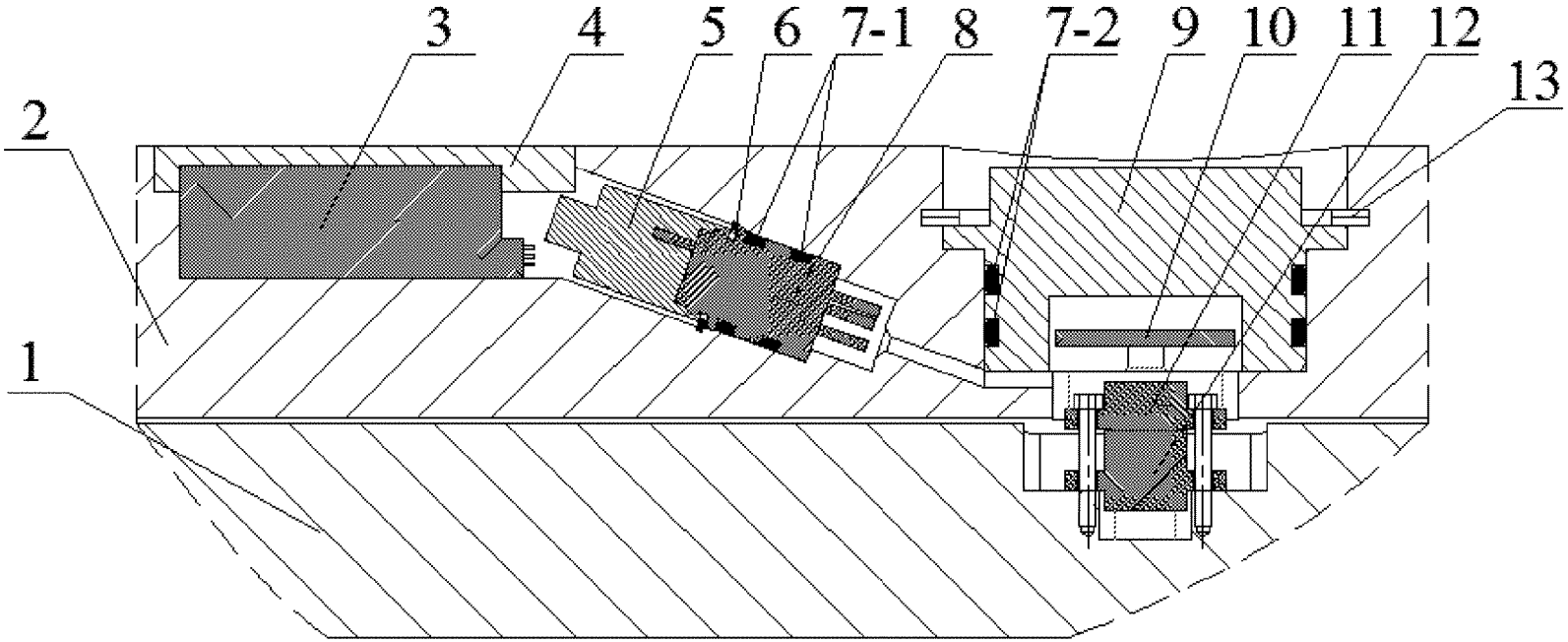
FIG. 1 is a schematic diagram showing an azimuthally acoustic while drilling signal receiving transducer encapsulating apparatus.

As shown in FIG. 1, an azimuthally acoustic while drilling signal receiving transducer encapsulating apparatus includes a drill collar body 2, a master control electronics housing 1 and an azimuthally acoustic while drilling signal receiving and processing system. The azimuthally acoustic while drilling signal receiving and processing system includes a receiving transducer 3, a preposed signal processing circuit 10, and a main signal processing circuit (not shown) disposed in the master control electronics housing 1.

The main signal processing circuit includes a power supply, a processor, a signal transmitting circuit, a signal amplification and conditioning unit, a data acquisition and processing unit, and a data storage unit having a memory, and instruments for inclination measurement and ultrasonic borehole diameter measurement. The power supply converts a power output from a battery, e.g., of 12V to 36V DC voltage, to a lower voltage (e.g., 5 V, 3.3 V, etc.) for the signal acquisition circuit and a higher voltage (e.g., 102 V) for the signal transmitting circuit. The processor periodically generates acquisition pulses through the internal timer according to the drilling speed. The signal transmitting circuit generates high-voltage pulses to excite the transmitting transducer in coordination with the acquisition pulses.

Further, coupled with the preposed signal processing circuit 10, the signal amplification and conditioning unit is configured to further receive, amplify, filter, and apply automatic gain control of the returning signals from the formation. The signal amplification and conditioning unit is coupled with the data acquisition and processing unit, which carries out full-wave acquisition. Subsequently, the waveform signals are stored in the memory in the data storage unit.

The sealing electrical connectors, the receiving transducer 3 and the preposed signal processing circuit 10 are subjected to high-pressure sealing on the drill collar body 2. The receiving transducer 3 and the signal processing circuit 10 are electrically connected through the sealing electrical connectors. The signal processing circuit 10 and the main signal processing circuit are also electrically connected.

The preposed signal processing circuit 10 include a signal amplifying device and an analog-to-digital conversion device. During operation, the preposed signal processing circuit 10 acquires an acoustic signal transmitted from the receiving transducer 3 and then amplifies it. The analog-to-digital conversion circuit converts the amplified signal into a valid signal. Then, the valid signal is transmitted into a main signal processing circuit housed in the master control electronics housing 1 for subsequent data processing. Such a structure separately performs receiving transducer encapsulating apparatus sealing and electrical connection sealing, thereby reducing requirements for machining and assembling parts and a design requirement for the electrical connector, and ensuring downhole operation reliability.

The receiving transducer 3 is connected with the sealing electrical connectors via a first signal transmission cable. There is a gap between the receiving transducer 3 and the sealing electrical connectors, which provides a space to store a section of the first signal transmission cable.

The preposed signal processing circuit 10 are connected with the sealing electrical connectors through a third signal transmission cable. The preposed signal processing circuit 10 are electrically connected with a second electrical connector mounted on the master control electronics housing 1 via a second signal transmission cable to realize electrical connection of the signal processing circuit 10 and the master control electronics housing 1. The preposed signal processing circuit 10 is connected with the master control electronic housing by adopting a flexible cable to avoid a design requirement for aligning the electrical connector of the master control electronic housing with the drill collar body.

The receiving transducer 3 performs signal transmission by using three outgoing cables, including a positive electrode, a negative electrode, and a ground. The sealing electrical connector includes a three-core sealing pin 8 and a three-core sealing rubber sleeve 5 which are engaged and mounted. The receiving transducer 3 is connected with the three-core sealing rubber sleeve 5 via a first signal transmission cable.

The electrical connector includes a multi-core connection pin 11 and a multi-core connection socket 12, which are engaged, the multi-core connecting socket 12 is mounted on the master control electronic housing 1. One of the second signal transmission cable is connected with the signal processing circuit 10 and the other end to the the multi-core connection pin 11.

The sealing electrical connector, an encapsulating structure of the receiving transducer 3 and an encapsulating structure of the preposed signal processing circuit 10 are both sealed under high pressure.

Figure 2:
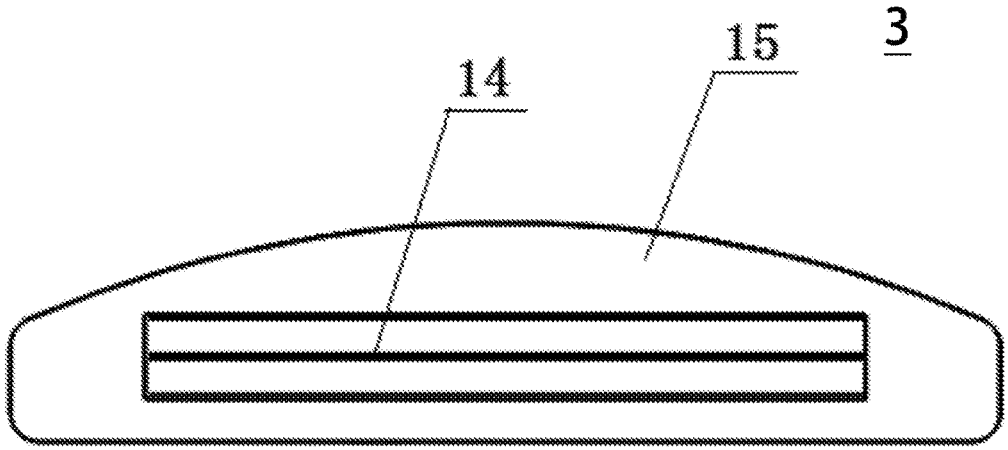
FIG. 2 is a schematic diagram showing a receiving transducer.
Figure 3:
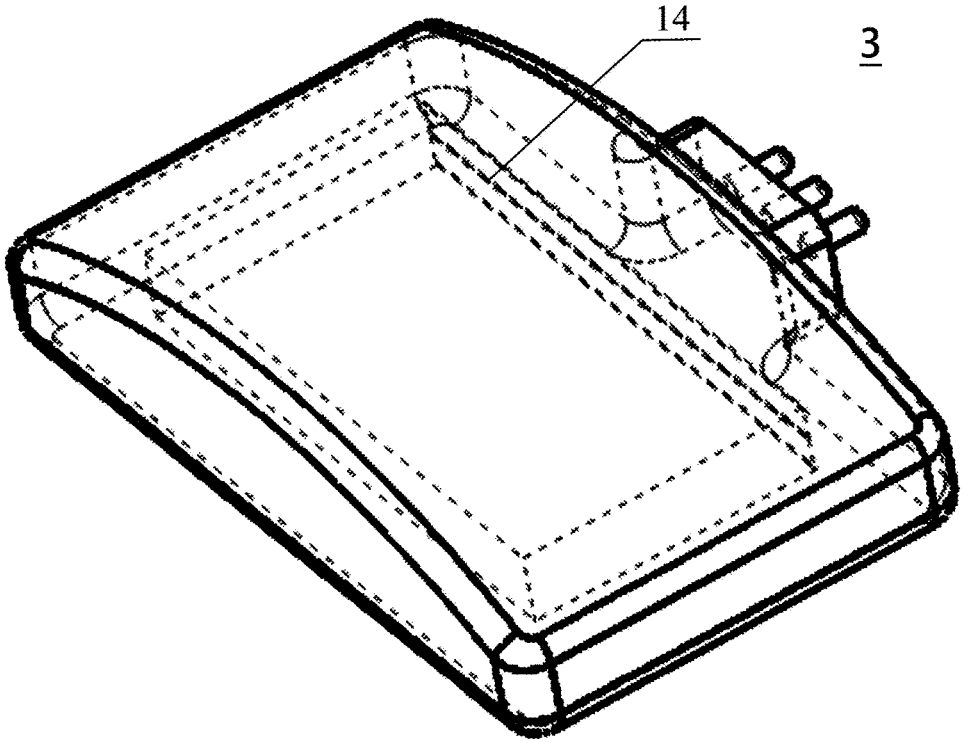
FIG. 3 is a schematic diagram showing a fixing apparatus for a receiving transducer.

The receiving transducer 3 is affixed to the drill collar body 2 by an encapsulating cover plate 4. As shown in FIG. 2, the receiving transducer 3 employs a wireline acoustic bicrystal sensor, an encapsulating structure is a rectangular parallelepiped structure having one cambered surface, and is formed by potting of an epoxy resin potting sealant, the receiving transducer 3 is potted within the encapsulating structure, and a signal is led out of the encapsulating structure via a first signal transmission cable while isolation of the receiving transducer 3 and the mud is realized. The receiving transducer 3 is affixed to the drill collar body 2 by the encapsulating cover plate 4. As shown in FIG. 3, a surface, of the encapsulating cover plate 4 in contact with the receiving transducer 3 is a cambered surface. The encapsulating structure having one cambered surface is employed to be suitable for a structure requirement of the drill collar body, to avoid a dynamic sealing design of the ceramic crystal plate. The encapsulating cover plate 4 of the receiving transducer similarly adopts an arc-shaped structure for enhancing a sound transmission effect, which ensures that a contact portion with the cambered surface of the transducer is uniform in thickness.

The encapsulating structure of the preposed signal processing circuit 10 is a sealing cover 9, the preposed signal processing circuit 10 are located within the sealing cover 9, and the sealing cover 9 is affixed to the drill collar body 2.

External portions of the sealing cover 9 and the three-core sealing pin 8 are sleeved with at least one sealing ring, respectively, to achieve high-pressure sealing and realize effective isolation of the mud and the signal processing circuit under high pressure.

The sealing cover 9 and the three-core sealing pin 8 are affixed to the drill collar body 2 by retaining rings, respectively. Further, the retaining rings are resilient to ensure that the sealing cover 9 and the three-core sealing pin 8 do not fall off the drill collar body in a downhole environment with strong vibration.

Figure 4:
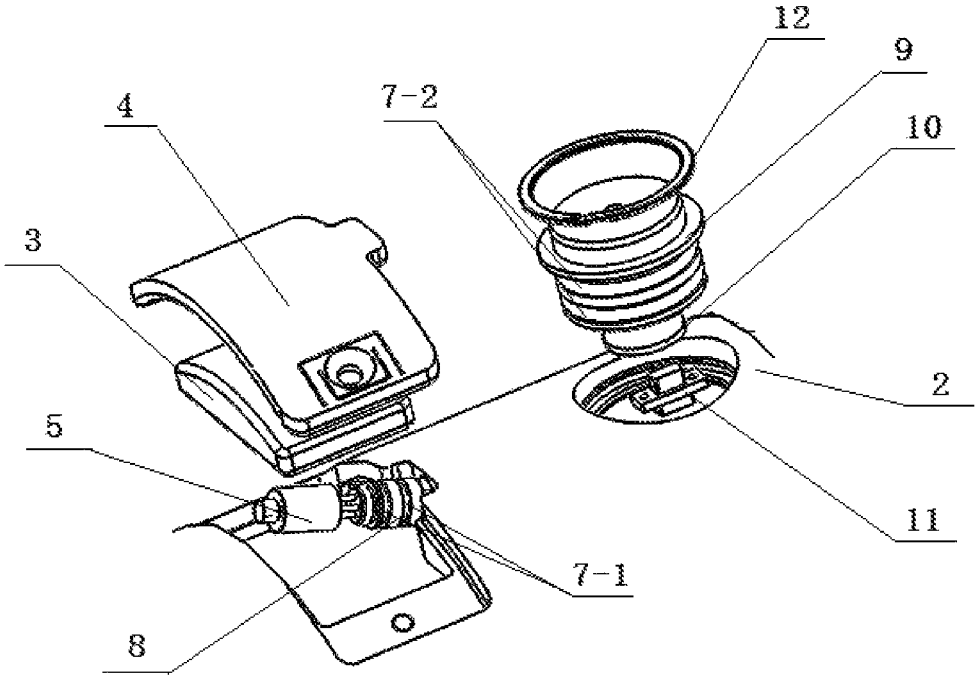
FIG. 4 is an exploded view showing an azimuthally acoustic while drilling signal receiving transducer encapsulating apparatus; and wherein 1. master control electronic housing; 2. drill collar body; 3. receiving transducer; 4. encapsulating cover plate; 5. three-core sealing rubber sleeve; 6. first retaining ring; 7-1. first sealing ring; 7-2. second sealing ring; 8. three-core sealing pin; 9. sealing cover; 10. preposed signal processing circuit; 11. multi-core connection pin; 12. multi-core connection socket; 13. second retaining ring; 14. dual-ceramic sheet sensor; and 15. polyurethane potting sealant.

In a practical application, as shown in FIG. 4, three signal transmission cables of the receiving transducer 3 are integrally connected with the three-core sealing rubber sleeve 5, respectively, and the three-core sealing pin 8 is connected with the preposed signal processing circuit 10. During installation, the three-core sealing pin 8 is firstly affixed to the drill collar body 2 by the first retaining ring 6 and the signal transmission cables at the ends of the three-core sealing pin 8 are inserted into a compartment where the preposed signal processing circuit 10 are located through a small hole and connected with the preposed signal processing circuit 10 by soldering; and then the three-core sealing rubber sleeve 5 and the three-core sealing pin 8 are engaged, and the receiving transducer 3 is fixed by using the encapsulating cover plate 4 of the transducer. There is a gap between the receiving transducer 3 and the three-core sealing rubber sleeve 5 for storing a portion of the transmission cable. The preposed signal processing circuit 10 is connected with the multi-core connection pin 11 through the signal transmission cables. During operation, the multi-core connection pin 11 is connected with the multi-core connection socket 12, wherein the multi-core connection socket 12 has been mounted on the master control electronics housing 1 as a signal interface, and then the preposed signal processing circuit 10 are mounted on the drill collar body 2. Further, the sealing cover 9 of the preposed signal processing circuit is affixed to the drill collar body 2 by means of an elastic retaining ring 13 to complete the sealing, mounting, and electrical connection of an azimuthally acoustic while drilling signal receiving transducer and the processing circuit.

The invention claimed is:

1. An azimuthally acoustic while drilling signal receiving transducer encapsulating apparatus comprising a drill collar body, a master control electronic housing, and an azimuthally acoustic while drilling signal receiving and processing system, wherein the azimuthally acoustic while drilling signal receiving and processing system comprises a receiving transducer, a sealing electrical connector, a preposed signal processing circuit, and a main signal processing circuit, wherein the main signal processing circuit is mounted on the master control electronic housing, wherein the drill collar body comprises a first cavity housing the preposed signal processing circuit, a second cavity housing the receiving transducer, and a conduit underneath a surface of the drill collar that connects the first cavity and the second cavity, wherein the sealing electrical connector is disposed inside the conduit between the first cavity and the second cavity, wherein the receiving transducer and the preposed signal processing circuit are electrically connected via the sealing electrical connector, and the preposed signal processing circuit and the main signal processing circuit are electrically connected, and wherein the preposed signal processing circuit comprises a signal amplifying circuit and an analog-to-digital conversion circuit.

2. The azimuthally acoustic while drilling signal receiving transducer encapsulating apparatus according to claim 1, wherein the preposed signal processing circuit is encapsulated by a first encapsulating structure, and the first encapsulating structure of the preposed signal processing circuit and an external portion of the sealing electrical connector are respectively sleeved with at least one sealing ring to realize high-pressure sealing.

3. The azimuthally acoustic while drilling signal receiving transducer encapsulating apparatus according to claim 1, wherein the preposed signal processing circuit is connected with an electrical connector mounted on the master control electronic housing through a second signal transmission cable.

4. The azimuthally acoustic while drilling signal receiving transducer encapsulating apparatus according to claim 1, wherein the receiving transducer comprises a sensor and a second encapsulating structure external to the sensor, the second encapsulating structure is formed by potting of an epoxy resin potting sealant that seals the sensor under high pressure, the receiving transducer is affixed to the second cavity in the drill collar body by means of a fixing apparatus, and a signal of the receiving transducer is led out of the second encapsulating structure through a first signal transmission cable.

5. The azimuthally acoustic while drilling signal receiving transducer encapsulating apparatus according to claim 4, wherein the second encapsulating structure is a rectangular parallelepiped structure having a cambered first surface, and a surface, wherein the second fixing apparatus has a second cambered surface in contact with the first cambered surface.

6. The azimuthally acoustic while drilling signal receiving transducer encapsulating apparatus according to claim 1, wherein the receiving transducer performs signal transmission via a positive electrode cable, a negative electrode cable, and a ground cable.

7. The azimuthally acoustic while drilling signal receiving transducer encapsulating apparatus according to claim 3, wherein the electrical connector comprises a multi-core connection pin and a multi-core connection socket, and the multi-core connection pin and the multi-core connection socket are engaged.

8. The azimuthally acoustic while drilling signal receiving transducer encapsulating apparatus according to claim 1, wherein a first encapsulating structure of the preposed signal processing circuit is a sealing cover that covers the first cavity in the drill collar.

9. The azimuthally acoustic while drilling signal receiving transducer encapsulating apparatus according to claim 1, wherein the sealing electrical connector comprises a three-core sealing pin and a three-core sealing rubber sleeve, which are mutually engaged and mounted, and the receiving transducer is connected with the three-core sealing rubber sleeve.

10. The azimuthally acoustic while drilling signal receiving transducer encapsulating apparatus according to claim 1, wherein the first encapsulating structure of the preposed signal processing circuit and the sealing electrical connector are affixed to the drill collar body by means of retaining rings, respectively, to ensure that they do not fall off from the drill collar body in a downhole environment with strong vibration.

* * * * *